United States Patent [19]

Yang

[11] Patent Number: 4,706,392

[45] Date of Patent: Nov. 17, 1987

[54] INTERCHANGEABLE SHOE AND SLIPPER COMBINATION

[76] Inventor: Tzu-Tsan Yang, P.O. Box 13-118, Taipei, Taiwan

[21] Appl. No.: 921,045

[22] Filed: Oct. 20, 1986

[51] Int. Cl.[4] ..... A43B 3/24; A43B 3/12; A43B 21/38

[52] U.S. Cl. ..... 36/101; 36/100; 36/42; 36/11.5

[58] Field of Search ..... 36/42, 100, 107, 11.5

[56] References Cited

U.S. PATENT DOCUMENTS

| | | | |
|---|---|---|---|
| 631,821 | 8/1899 | Riemer | 36/101 |
| 2,236,367 | 3/1941 | Gruber | 36/101 |
| 2,302,596 | 11/1942 | Bigio | 36/101 |
| 2,491,930 | 12/1949 | Parlante | 36/101 |
| 2,493,154 | 1/1950 | Mavrakis | 36/101 |
| 2,686,376 | 8/1954 | Burkholz | 36/101 |
| 2,809,449 | 10/1957 | Smith | 36/101 |
| 3,225,466 | 12/1965 | Milk et al. | 36/42 |
| 4,103,440 | 8/1978 | Lawrence | 36/101 |
| 4,214,383 | 7/1980 | Allen | 36/101 |
| 4,219,946 | 9/1980 | Baum | 36/42 |
| 4,363,177 | 12/1982 | Boros | 36/101 |

FOREIGN PATENT DOCUMENTS

| | | | |
|---|---|---|---|
| 6501 | 3/1895 | Sweden | 36/101 |

*Primary Examiner*—Werner H. Schroeder
*Assistant Examiner*—Steven N. Meyers

[57] ABSTRACT

An interchangeable shoe and slipper combination includes an upper having a front upper portion secured on a sole and a rear upper portion. A slide fastener couples or uncouples the front upper portion and the rear upper portion so as to assemble a shoe, or form a slipper by separating the rear upper portion from the front upper portion. A detachable heel is fixed under the sole, which includes several heel sections selectively fixed under the sole for adjusting the heel height of the shoe.

2 Claims, 4 Drawing Figures

INTERCHANGEABLE SHOE AND SLIPPER COMBINATION

BACKGROUND OF THE INVENTION

Conventional shoes are usually made as a fixed type so that an additional slipper must be provided as comfortable home wearing footwear thereby causing inconvenience for the wearer.

Meanwhile, such conventional shoes are formed with a fixed heel secured under a sole and lack the convenience of adjusting the height of such a fixed-type heel, thereby making it impossible to adjust the heel height according to the wearer's choice.

The present inventor has identified such a problem and invented the present interchangeable shoe and slipper combination with adjustable heel height.

SUMMARY OF THE INVENTION

One object of the present invention is to provide a combination of a shoe and a slipper interchangeably assembled or disassembled to become either a shoe or a slipper for convenient dual purposes for its wearer.

The other object of the present invention is to provide a shoe having a plurality of heel sections which can be optionally adjustably mounted under the shoe sole for the user's convenient choice of a heel height.

DETAILED DESCRIPTION

Figure 1:
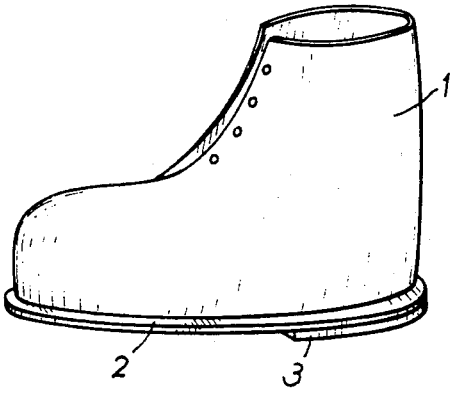
FIG. 1 PRIOR ART
FIG. 1 shows a conventional fixed type shoe.
Figure 2:
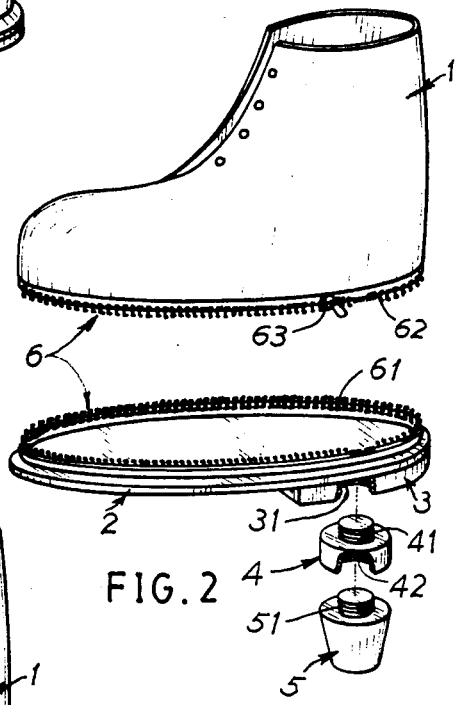
FIG. 2 is a perspective view of the present invention when disassembled.

As shown in FIG. 2, the present invention comprises: an upper 1; a sole 2; a detachable heel means including a first-section heel 3, a second-section heel 4 and a third-section heel 5 superimposedly secured under the sole 2, and a separable slide fastener 6 coupling or uncoupling the upper 1 and the sole 2. The slide fastener 6 includes a lower strip 61 formed on an upper perimeter of the sole 2, an upper strip 62 formed on a lower perimeter of the upper 2 and a coupler 63 operatively coupling or uncoupling the upper 1 and the sole 2, so that the upper 1 can be disassembled from the sole 2 for replacing a new upper 1, so as to be more convenient than a conventional fixed-type shoe as shown in FIG. 1.

The detachable heel means includes a first-section heel 3 formed under the sole 2 having a screw hole 31 formed thereunder, a second-section heel 4 having a screw portion 41 formed on its top portion adapted to engage with the screw hole 31 of the first-section heel 3 and a screw hole 42 formed on its bottom portion, and a third-section heel 5 having a screw portion 51 formed on its top portion adapted to engage with the screw hole 42 of the second-section heel 4. For adjusting the heel height, the second and third-section heels 4, 5 can be all disassembled from the first-section heel 3 to form the lowest height of the present invention. By superimposing all heels 4, 5 under the first-section heel 3, the maximum height for the present invention is set. If by omitting the second-section heel 4 and by engaging the screw portion 51 of the third-section heel 5 with the screw hole 31 of first-section heel 3, a medium-height shoe can be formed. After longer use of the assembled shoe having the three heels 3, 4, 5, only the worn lowest heel 5 is replaced with new one.

Figure 3:
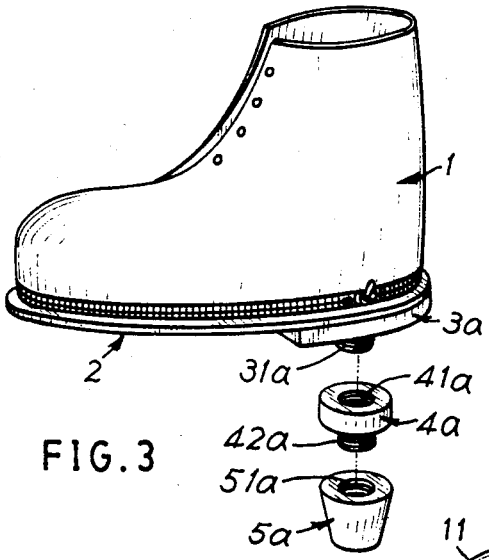
FIG. 3 shows another embodiment of the present invention.

By modifying the screw and screw holes as disclosed in FIG. 2, another preferred embodiment of the present invention can be formed, as shown in FIG. 3, to include a first-section heel 3*a* formed with a screw portion 31*a* on its bottom portion, a second-section heel 4*a* having a screw hole 41*a* formed on its upper surface adapted to engage with the screw portion 31*a* and a screw portion 42*a* formed on its bottom portion, and a third-section heel 5*a* formed with a screw hole 51*a* on its upper surface adapted to engage with the screw portion 42*a* of the second-section heel 4*a*.

Figure 4:
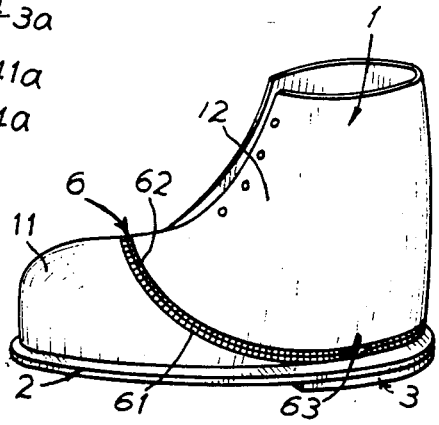
FIG. 4 shows still another embodiment of the present invention.

In FIG. 4, a still another preferred embodiment of the present invention is shown, which comprises: an upper 1 having a front upper portion 11 adapted for covering a wearer's toes and a rear upper portion 12 coupled or uncoupled to the front upper portion 11 adapted to cover a wearer's instep, a sole 2, a heel 3 and a slide fastener 6 coupling or uncoupling the front upper portion 11 and the rear upper portion 12.

The lower perimeter of the front upper portion 11 is secured on the sole 2. A lower strip 61 of the slide fastener 6 includes a front strip portion formed on the opening edge of the front upper portion 11 and a rear strip portion formed on the rear edge of the sole 2. An upper strip 62 includes a front strip portion formed on the front opening edge of the rear upper portion 12 adapted to couple the front strip portion of the lower strip 61 and a rear strip portion formed on the rear opening edge of the rear upper portion 12 adapted to couple with the rear strip portion of the lower strip 61, and a coupler 63 adatped to couple the upper strip 62 and the lower strip 61 so as to assemble a shoe as shown in FIG. 4.

When disassembling the front upper portion 11 from the rear upper portion 12 of the upper 1, the rear upper portion 12 can be removed such that the front upper portion 11 remains secured with the sole 2 to become a slipper for comfortable home wearing.

I claim:

1. An interchangeable shoe and slipper combination comprising: an upper, a sole, a detachable heel means fixed under the sole, and a separable slide fastener adapted to couple or uncouple the upper and the sole, the improvement which comprises:

said upper including a front upper portion adapted for covering a wearer's toes having the lower perimeter of said front upper portion secured on the sole, and a rear upper portion coupled to said front upper portion by said slide fastener;

said slide fastener including a lower strip having a front strip portion formed on an opening edge of said front upper portion and having a rear strip portion formed on the rear edge of said sole, and an upper strip having a front strip portion operatively coupled to the front strip portion of said lower strip and having a rear strip portion operatively coupled to the rear strip portion of said lower strip, and a coupler which couples said front upper portion with said rear upper portion to form an assembled shoe and adapted to uncouple the two said upper portions to separate said rear upper portion from said front upper portion to become a slipper.

2. An interchangeable shoe and slipper combination according to claim 1, wherein said detachable heel means includes a first-section heel having a screw hole formed on its bottom, a second-section heel having a screw formed on the upper surface of said second-section heel adapted to engage with the screw hole of said first-section heel and a screw hole formed on the bottom of said second-section heel, and a third-section heel formed a screw on its upper surface adapted to engage with the screw hole of said second-section heel, to thereby form a detachable heel means by selectively adjustably superimposing said second-section heel and said third-section heel under said first-section heel.

* * * * *